US011073170B2

(12) United States Patent
Lappalainen et al.

(10) Patent No.: US 11,073,170 B2
(45) Date of Patent: Jul. 27, 2021

(54) HYDRAULIC SYSTEM AND A CONTROL SYSTEM FOR THE SAME

(71) Applicant: NORRHYDRO OY, Rovaniemi (FI)

(72) Inventors: Ari Lappalainen, Tampere (FI); Mika Sahlman, Tampere (FI); Jussi Mäkitalo, Tampere (FI); Peter Stambro, Hawthorn Woods, IL (US)

(73) Assignee: NORRHYDRO OY, Rovaniemi (FI)

( * ) Notice: Subject to any disclaimer, the term of this patent is extended or adjusted under 35 U.S.C. 154(b) by 0 days.

(21) Appl. No.: 16/755,079

(22) PCT Filed: Oct. 5, 2018

(86) PCT No.: PCT/FI2018/050716
§ 371 (c)(1),
(2) Date: Apr. 9, 2020

(87) PCT Pub. No.: WO2019/073114
PCT Pub. Date: Apr. 18, 2019

(65) Prior Publication Data

US 2020/0300273 A1 Sep. 24, 2020

(30) Foreign Application Priority Data

Oct. 9, 2017 (FI) ..... 20175884

(51) Int. Cl.
*F15B 1/02* (2006.01)
*F15B 11/04* (2006.01)

(52) U.S. Cl.
CPC ..... *F15B 1/024* (2013.01); *F15B 11/04* (2013.01); *F15B 2201/515* (2013.01);
(Continued)

(58) Field of Classification Search
None
See application file for complete search history.

(56) References Cited

U.S. PATENT DOCUMENTS 8,984,872 B2 * 3/2015 Nelson ..... G01M 99/00 60/418
2012/0060777 A1 3/2012 Tikkanen et al.

FOREIGN PATENT DOCUMENTS

DE 10 2013 114 040 A1 6/2015
WO 2007/104539 A1 9/2007
(Continued)

OTHER PUBLICATIONS

Jan. 25, 2019 International Search Report issued in International Patent Application No. PCT/FI2018/050716.

*Primary Examiner* — Thomas E Lazo
*Assistant Examiner* — Michael Quandt
(74) *Attorney, Agent, or Firm* — Oliff PLC

(57) ABSTRACT

A hydraulic system including: a pressure line; a pump; an actuator; a valve device configured to control the flow of pressurized hydraulic fluid to the actuator; an electronic control unit configured to control the valve device by a control signal proportional to the desired speed of the actuator at any given time; a pressure accumulator capable of supplying, together with the pump, pressurized hydraulic fluid for moving the actuator; a sensor device configured to measure, directly or indirectly, the amount of pressurized hydraulic fluid in the pressure accumulator at any given time; setting devices configured to set a setting signal to be proportional with the desired speed of the actuator at any given time. The electronic control unit is configured to restrict the targeted speed of the actuator not to exceed a predetermined maximum speed which is proportional to the amount of pressurized hydraulic fluid in the pressure accumulator.

17 Claims, 2 Drawing Sheets

(52) U.S. Cl.
CPC . *F15B 2211/212* (2013.01); *F15B 2211/6309* (2013.01); *F15B 2211/6346* (2013.01); *F15B 2211/75* (2013.01)

(56) References Cited

FOREIGN PATENT DOCUMENTS

| | | | |
|---|---|---|---|
| WO | 2010/040890 | A1 | 4/2010 |
| WO | 2014/120930 | A1 | 8/2014 |
| WO | 2016/040484 | A1 | 3/2016 |

* cited by examiner

HYDRAULIC SYSTEM AND A CONTROL SYSTEM FOR THE SAME

FIELD OF THE INVENTION

The solution presented relates to a system comprising a hydraulic system and a control system for the same. The solution presented also relates to a method for controlling the hydraulic system.

BACKGROUND OF THE INVENTION

Hydraulic systems apply hydraulic pressure accumulators for receiving and storing pressurized hydraulic fluid. Pressurized hydraulic fluid may be returned from the pressure accumulator to the hydraulic system, if needed. Consequently, a given amount of energy can be stored in the pressure accumulator, to be returned for use in the hydraulic system, for example to one or more hydraulic actuators. A volume flow of hydraulic fluid can be conveyed from the pressure accumulator to the actuator which may be kept in motion by said volume flow from the pressure accumulator.

A predetermined maximum amount of hydraulic fluid may be stored in the pressure accumulator so that, for example, the movement of an actuator cannot be maintained indefinitely, because the pressure accumulator will be exhausted and normally its pressure will go down simultaneously. Running out of the volume flow of hydraulic fluid may result in such changes in the behaviour of the actuator that are uncontrollable or undesirable, such as an abrupt reduction in the speed of the actuator.

BRIEF SUMMARY OF THE INVENTION

The system according to the solution presented, operated hydraulically, comprises a pressure line providing pressurized hydraulic fluid; a pump configured to supply pressurized hydraulic fluid to the pressure line; an actuator connected to the pressure line for receiving pressurized hydraulic fluid from the pressure line and for moving the actuator; a valve device configured to control the flow of pressurized hydraulic fluid from the pressure line to the actuator, and the speed of the actuator; an electronic control unit configured to monitor and control the functions of the system, to control the valve device by a control signal which is proportional to the desired speed of the actuator at any given time; a pressure accumulator connected to the pressure line from which the pressure accumulator may receive pressurized hydraulic fluid and to which the pressure accumulator may, simultaneously with a pump, supply pressurized hydraulic fluid for running the actuator; a sensor device configured to measure, directly or indirectly, the amount of pressurized hydraulic fluid in the pressure accumulator at any given time, and configured to transmit a measurement signal proportional to said amount of pressurized hydraulic fluid to the electronic control unit; and setting devices configured to generate a setting signal and to set said control signal to be proportional to the speed of the actuator desired at any given time.

In the presented solution, said electronic control unit is configured to limit the targeted speed of the actuator not to exceed a predetermined maximum speed, the maximum speed being proportional to the amount of pressurized hydraulic fluid in the pressure accumulator.

In an example of the solution presented, the electronic control unit is configured to limit the targeted speed of the actuator to a maximum speed which is proportional to not only the above mentioned amount but also the pressure of the pressurized hydraulic fluid in the pressure accumulator.

In an example of the presented solution, the electronic control unit is configured to limit the targeted speed of the actuator to a maximum speed which is proportional to not only the above mentioned amount and pressure but also the power generated by the actuator at any given time.

In the method according to the solution presented, the targeted speed of the actuator is limited not to exceed a predetermined maximum speed which is proportional to the amount of pressurized hydraulic fluid in the pressure accumulator.

The system according to the solution presented may be applied in a crane which comprises a boom for lifting and transferring loads, or in a machine which may be used for lifting or transferring loads. Said boom is configured to be movable by said system. Said boom may be placed in a mobile machine.

The hydraulic control system according to the solution presented has the advantage of maximum utilization of the energy stored in the pressure accumulator, avoiding an abrupt change in the speed of the actuator, caused by exhaustion of the pressure accumulator.

DESCRIPTION OF THE DRAWINGS

The presented solution will be described in greater detail in the following, with reference to the accompanying drawings.

DETAILED DESCRIPTION OF THE INVENTION

Figure 1:
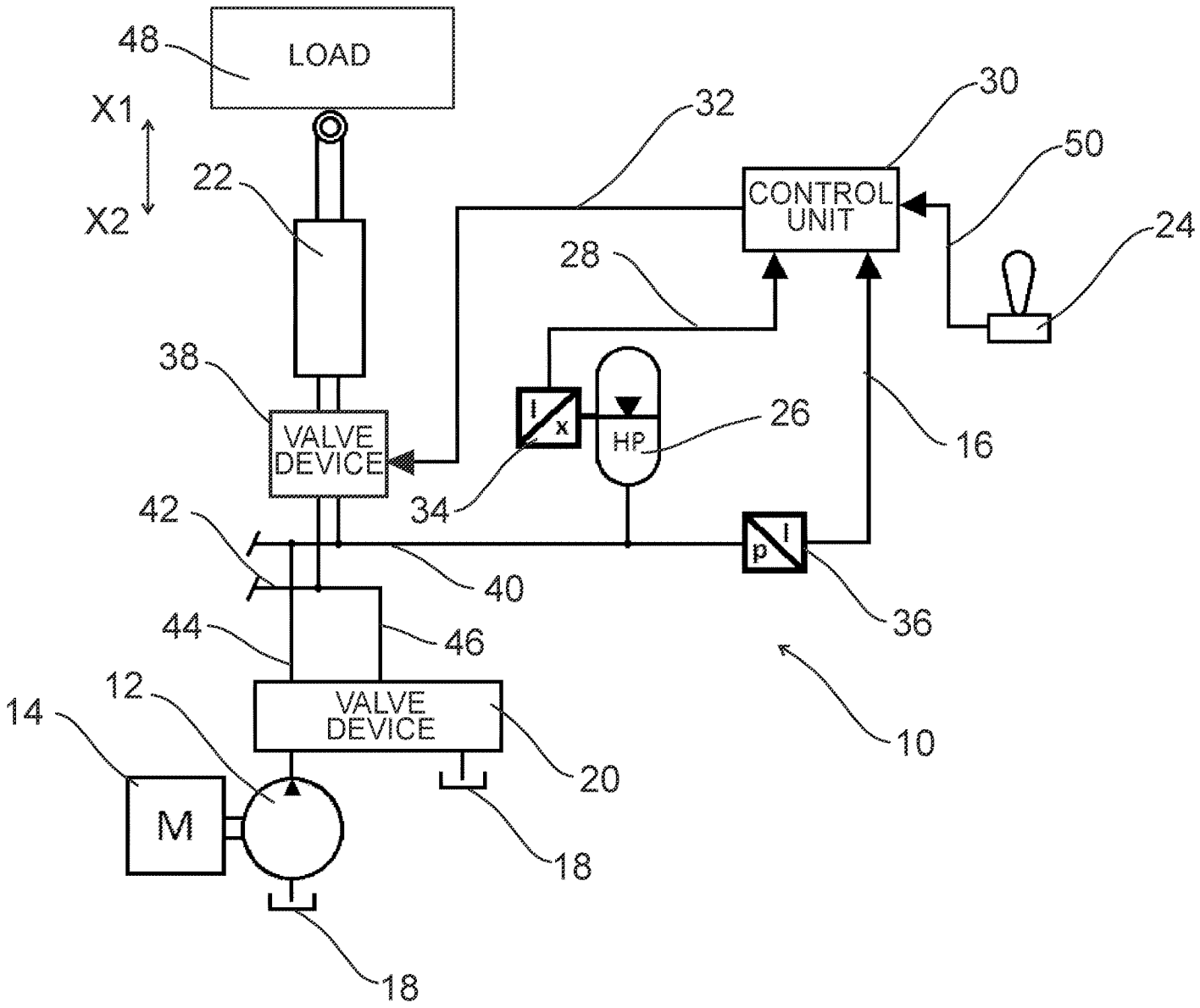
FIG. 1 shows a principle of implementing a hydraulic system and its control system, in which the solution presented can be applied.

FIG. 1 shows an example of a hydraulic system and control system for controlling it, in which example the solution presented may be applied.

The hydraulic system according to the solution presented, and its control system, in other words a system 10, comprises a pressure line 40, at least one actuator 22, at least one valve device 38 for controlling the volume flow of hydraulic fluid, at least one hydraulic pressure accumulator 26, at least one sensor device 34 and/or a sensor device 36, at least one hydraulic pump 12, and an electronic control unit 30 controlling the operation of the system 10.

The actuator 22 may be configured to move a load 48 to which the actuator applies a force which is dependent on the pressure of the hydraulic fluid supplied to the actuator 22, and the sizing of the actuator 22. Preferably, it is a linear actuator, for example a hydraulic cylinder, comprising a reciprocating piston. The actuator 22 is configured to move in two opposite directions X1 and X2. When hydraulic fluid is supplied to the actuator 22, the actuator 22 either expands and moves in the direction X1, or contracts and moves in the direction X2. In an example, when hydraulic fluid is conveyed away from the actuator 22, the actuator 22 moves in the opposite direction with respect to the situation in which hydraulic fluid is supplied into the actuator 22. The speed of the actuator 22, its piston, or the load 48 will depend on the sizing of the actuator 22 and the volume flow rate of hydraulic fluid supplied to the actuator 22, that is, the flow of hydraulic fluid per unit of time, and the volume of the actuator 22.

The actuator 22 is connected to the pressure line 40 for supplying pressurized hydraulic fluid to the actuator 22. Valve devices, such as a valve device 20, may be connected to the pressure line 40 for limiting the pressure of hydraulic fluid in the pressure line 40 to a predetermined maximum value.

The actuator 22 may be single or double acting. The actuator 22 may be a single chamber, double chamber or multi chamber actuator. For moving the actuator 22, hydraulic fluid is supplied to one or more chambers of the actuator 22 simultaneously. During the operation of the actuator 22, hydraulic fluid may exit one or more chambers of the actuator 22 simultaneously.

The pump 12 is configured to supply pressurized hydraulic fluid to the pressure line 40. The pump 12 is connected to the pressure line 40 via, for example, a line 44. The maximum volume flow and the maximum pressure of the hydraulic fluid produced by the pump 12 will depend on the sizing of the pump 12.

The pump 12 is of a fixed volume type or preferably an adjustable-displacement pump, whereby the volume flow produced by the pump 12 can be adjusted, for example, within limits set by predetermined minimum and maximum values. The pump 12 is rotated by a motor 14. The motor 14 is, for example, an electric motor or a combustion engine.

The pump 12 is supplied with hydraulic fluid from, for example, a tank 18 for hydraulic fluid.

The hydraulic fluid is returned from the actuator 22 to, for example, another pressure line 42, in which the pressure of the hydraulic fluid is lower than in the pressure line 40. The pressure line 42 may also be used as a tank line, via which the hydraulic fluid returning from the actuator 22 will flow into the tank 18. The tank 18 is connected to the pressure line 40 via, for example, a line 46.

The system 10 may comprise a valve device 20 by which the access and flow of hydraulic fluid from the pump 12 to the pressure line 40, and vice versa, can be controlled. The valve device 20 may be placed, for example, in the line 44. The valve device 20 may also be configured to control the access and flow of hydraulic fluid from the pressure line 40 to the tank 18. The valve device 20 may comprise one or more control valves.

The valve device 38 controls the flow of hydraulic fluid from the pressure line 40 to the actuator 22, for example to and from one or more of its chambers. Preferably, the valve device 38 is also configured to close the connection and the volume flow between the pressure line 40 and the actuator. The valve device 38 controls the volume flow rate of the hydraulic fluid, on which the speed of the actuator 22, in turn, is dependent. The maximum volume flow dependent on the sizing of the valve device 38 simultaneously determines the maximum speed of the actuator 22. For adjusting the volume flow, the valve device 38 is preferably electronically controllable.

The valve device 38 may comprise one or more control valves which may be, for example, of the type of a proportional directional valve which is electronically controllable and whose volume flow is proportional to a control signal received by the valve device 38. Said control valve is, for example, a proportional two-way two-position directional control valve. Said control valve may be a position feedback valve, a force feedback valve, or a speed feedback valve. For each chamber of the actuator 22, one control valve or several parallel control valves are provided for supplying hydraulic fluid from the pressure line 40 to the actuator 20. Alternatively, said parallel control valves may be, for example, on/off controlled directional valves or shut-off valves.

The valve device 38 is controlled by an electronic control unit 30 which may comprise, for example, one or more electronic control cards for controlling the valve device 38. The function of the control unit 30 is to generate a control signal 32, for example a current signal, for controlling the valve device 38.

The functions of the system 10 are monitored and controlled by the control unit 30. The control unit 30 is preferably a programmable microprocessor based device which runs one or more control algorithms stored in its memory and performing computing and logic functions. The control unit 30 comprises the interface for connecting, for example, signals generated by sensors and control devices, and for connecting control signals generated in the control unit 30. Said control algorithms produce, for example on the basis of said signals, a predetermined control signal at any given time. The control unit 30 is, or may be, provided with user interface devices for controlling the operation of the control unit 30. The control unit 30 may be based on a programmable logic or a computer operated under control of a control program or a user. The control unit 30 may consist of one or several separate devices, or it may constitute a distributed system whose different parts or devices are connected to each other or communicate with each other.

The control signal 32 is dependent on, for example, the speed of the actuator 22 or the volume flow which is to be implemented by the valve device 38 at any given time. In generating said control signal 32, a controller may be applied, such as a PID controller, which is implemented in the control unit 30 and is based on, for example, position feedback, force feedback, or speed feedback. For the control, the system 10 may comprise sensor devices for measuring the speed of the actuator 22 and for transmitting said measurement signal to the control unit 30.

The system 10 may also comprise one or more control devices 24 connected to the control unit 30 for the purpose of controlling the system 10, for example the actuator 22 therein. The control device 24 is, for example, manually controllable, in one example a control stick. The control stick is operated by a user.

The control device 24 is configured to generate a setting signal 50 dependent on the position of the control device 24, for example the inclination of the control stick. Said setting signal 50 is input in the control unit 30.

Alternatively, said setting signal 50 can be input with input devices, which may include, for example, the control unit 30 or a part of it, a device connected to the control unit 30, or the above described control device 24. In the control unit 30, the setting signal 50 may be input manually by user interface devices of the control unit 30, or it may be generated by software by running control algorithms for influencing the speed of the actuator 22.

For example, the control device 24 is used to control the speed of the actuator 22 so that the speed of the actuator 22 is different in different positions of the control device 24 or control stick. The desired speed of the actuator 22 is proportional to the position of the control device 24 or control stick. The control algorithm of the control unit 30 is configured to control the valve device 38 on the basis of the setting signal 50 so that the desired speed of the actuator 22 is achieved.

The pressure accumulator 26 is connected to the pressure line 40, from which the pressure accumulator 26 may receive pressurized hydraulic fluid and to which the pressure accumulator 26 gives pressurized hydraulic fluid. The pressure accumulator 26 has a predetermined effective volume based on its sizing and proportional to the maximum quantity of hydraulic fluid that can be supplied from the pressure accumulator 26 to the pressure line 40, for example within a given period of time.

The pressure accumulator 26 may be a weight loaded accumulator, a spring loaded accumulator, or preferably a gas loaded accumulator. The type of said gas loaded accumulator is a bladder accumulator or a membrane accumulator, or preferably a piston accumulator. It is typical of a gas loaded accumulator that the pressure of the hydraulic fluid contained in it decreases as the amount of said hydraulic fluid decreases.

If necessary, on the basis of the above mentioned dependence, the amount of hydraulic fluid in the pressure accumulator 26 can be estimated by measuring the pressure of said hydraulic fluid, for example, in the line to which the pressure accumulator 26 is connected, such as the pressure line 40.

For charging, the pressure accumulator 26 can be supplied with pressurized hydraulic fluid. The pressure accumulator 26 is sized, for example, to receive hydraulic fluid when the pressure of the hydraulic line 40 is equal to or higher than a predetermined minimum pressure. The sizing of a gas loaded accumulator is based on e.g. the pre-charge pressure of the gas used in the pressure accumulator. Said minimum pressure is selected to be e.g. lower than the pressure prevailing in the pressure line 40, for example, when a load 48 is moved by the actuator 22 or when the actuator 22 is at rest.

The pressure line 40 may be provided with a sensor device 36 configured to measure the pressure of the hydraulic fluid contained in the pressure line 40. The system 10 may also comprise other sensor devices which measure the pressure of the hydraulic fluid and are connected to the control unit 30, for example for measuring the pressure in the pressure line 40.

The sensor device 36 generates a measurement signal 16 which is, for example, electronic, the measurement signal 16 being proportional to the measured pressure. The signal is, for example, a current signal. The sensor device 36 is connected to the control unit 30 for transmitting the measurement signal 16 to the control unit 30 where the measurement signal 16 is an input for a control algorithm.

On the basis of the measurement signal 16 generated by the sensor device 36, the amount of hydraulic fluid in the pressure accumulator 26 can be measured indirectly by measuring the pressure in the pressure line 40. The control unit 30 is configured to deduce the amount of hydraulic fluid in the pressure accumulator from e.g. the properties of the pressure accumulator 26 and said pressure. In said deduction, the control unit 30 may take into account, for example, the known behaviour of changes, e.g. an adiabatic change, in the pre-charge pressure or in the volume of the gas in the pressure accumulator 26. In the pressure accumulator 26, the pressure of the gas follows the pressure of the hydraulic fluid which, in turn, tends to follow the pressure in the pressure line 40, and the volume of the gas, in turn, is dependent on the pressure of the gas.

In an alternative of the solution presented, the system 10 comprises a sensor device 34 connected to the pressure accumulator 26 and configured to measure the amount of hydraulic fluid in the pressure accumulator 26, either directly or indirectly. The sensor device 34 may be configured to measure the amount of hydraulic fluid e.g. indirectly, based on the measured position of a moving part of the pressure accumulator 26, dependent on the amount of hydraulic fluid. Said part may be, for example, the bladder of a bladder accumulator, the membrane of a membrane accumulator, or preferably the piston of a piston accumulator. The operation of the sensor device 34 may be based on touchless measurement, a linear sensor, or a cable traction device.

The sensor device 34 generates a measurement signal 28 which is, for example, electronic, the measurement signal 28 being proportional to the amount of hydraulic fluid in the pressure accumulator, or the above mentioned measured position. The signal is, for example, a current signal. The sensor device 34 is connected to the control unit 30 for transmitting the measurement signal 28 to the control unit 30 where the measurement signal 28 is an input for a control algorithm. Either the sensor device 34 or the control unit 30 and its control algorithm may deduce the amount of hydraulic fluid in the pressure accumulator 26, proportional to said measured position.

With the sensor device 34, a precise measurement signal 28 can be achieved in a simple way, when uncertainties relating to the measurement of the pressure and the behaviour of the gas are to be avoided.

The pressure accumulator 26 and the pump 12 are configured to supply hydraulic fluid to the actuator 22 via the pressure line 40 and the valve device 38 simultaneously, for moving the actuator 22. The pressure of the hydraulic fluid is thus, according to a first example, sized to be sufficient to move at least the actuator 22 and also a load 48, if necessary. The magnitude of the load 48 may be different or vary in different situations, whereby the force needed for moving it may vary. When the actuator 22 and the load 48 stop, the pressure may increase further up to the maximum value set for the pressure line 40, and the pressure accumulator 26 may be charged with pressurized hydraulic fluid. Alternatively, upon a sufficient increase in the pressure during movement of the actuator 22 and the load 48, the pressure accumulator 26 may be charged with pressurized hydraulic fluid.

The maximum overall volume flow produced by the pressure accumulator 26 and the pump 12 will determine the maximum speed of the actuator 22, because the volume flow represents the quantity of hydraulic fluid flowing per time unit. In the solution presented, the maximum volume flow produced by the pump 12 is lower than said maximum overall volume flow. In an example, the maximum volume flow produced by the pump 12 is 80%, 60%, 40%, or 20% of said maximum overall volume flow, or lower.

The speed of the actuator 22 is controlled to be lower than said maximum speed by using a valve device 38 which is controlled by a control signal 32 generated by the control unit 30 on the basis of e.g. a setting signal 50.

The pressure accumulator 26 may be in a state in which the total amount of hydraulic fluid in it is lower than the quantity of hydraulic fluid to be supplied from the pressure accumulator 26 to the actuator 22 for moving the actuator 22 a desired or predetermined distance at a desired speed, under control of the valve device 38 and, for example, the setting signal 50.

In the presented solution, the maximum volume flow produced by the pump 12 is sized to be lower than the volume flow of hydraulic fluid to be supplied from the pressure line 40 to the actuator 22 for moving the actuator 22 at the maximum speed. In an example, the maximum volume flow produced by the pump 12 is configured to generate 80%, 60%, 40%, or 20% of said maximum speed, or less.

The system 10 may be in the above described situation in which the total amount of hydraulic fluid in the pressure accumulator 26 is not sufficient for the entire desired travel distance of the actuator 22. Thus, as the pressure accumulator 26 is being exhausted, the speed of the actuator 22 may fall down from the desired speed in an abrupt and uncontrolled manner, after which the movement of the actuator 22 will be continued at a speed dependent on the volume flow produced by the pump 12.

In the presented solution, the aim is to avoid the above described problem.

In the presented solution, the amount of hydraulic fluid in the pressure accumulator 26 at any given time is monitored by the control unit 30, by utilizing the sensor device 34 and/or the sensor device 36 as described above.

The control unit 30 is, under control of a control algorithm, configured to restrict the maximum speed of the actuator 22 to a maximum value proportional to the amount of hydraulic fluid in the pressure accumulator 26. Consequently, the speed of the actuator 22 can be controlled to have only such a value or magnitude that said speed, at its highest, is equal to or lower than said maximum value. The speed of the actuator 22 is controlled by the valve device 38 and e.g. the setting signal 50, as described above.

As the restricting is only based on the amount of hydraulic fluid in the pressure accumulator 26, a simple operation is achieved, in terms of the control.

Thus, when the above described restriction is in use, the setting signal 50 cannot be used to adjust the speed of the actuator 22 to a value that exceeds the above mentioned maximum value. The control unit 30 controls the valve device 38 in such a way that the control signal 32 generated by the control unit 30 and the control algorithm is now dependent on not only the setting signal 50 but also the amount of hydraulic fluid in the pressure accumulator 26. The amount of hydraulic fluid in the pressure accumulator 26, in turn, is measured by the sensor device 34 and/or the sensor device 36.

If the system 10 comprises the control device 24, a predetermined position of the control device 24 will generate a predetermined setting signal 50. Thus, when the above described restriction is in use, a given position of the control device 24 will result in such a speed of the actuator 22 that may be lower than the speed resulting from the same position in a situation in which the above described restriction is not in use. In such a situation, the user of the control device 24 will detect a deceleration of the actuator 22 even if the user would not change the position of the control device 24.

By means of the above described restricting, it is possible to control the changing of the speed of the actuator 22, whereby an abrupt and uncontrolled drop in the speed, as described above, is avoided.

The volume flow supplied by the pressure accumulator 26 to the actuator 22 will depend on the sizing of the connections, the pressure line 40 and the valve device 38, such as the nominal size of the control valve. In the above described method, when the restricting is not in use, the valve device 38 may be controlled so that the flow of hydraulic fluid is not restricted and/or the flow opening(s) of one or more control valves therein is (are) the largest. When the restricting is to be taken into use, the valve device 38 is controlled so that the flow of hydraulic fluid is restricted and/or the flow opening(s) of one or more control valves therein is (are) made smaller.

According to an example of the solution presented, the control unit 30 is, under control of a control algorithm, configured to restrict the speed of the actuator 22 in the above described way, taking into account the amount of hydraulic fluid in the pressure accumulator 26, as well as the pressure of the hydraulic fluid in the pressure accumulator 26. Said pressure is determined by, for example, the sensor device 36.

On the basis of said amount and pressure, the control unit 30 deduces the amount of energy stored in the pressure accumulator 26. The pressure accumulator 26 supplies energy on the basis of its amount of pressurized hydraulic fluid which can be supplied in a given time and at a given volume flow rate. The aim is to secure the energy supply by also restricting the power of the actuator 22 so that its speed is simultaneously restricted in a desired way. The speed can be determined, for example, on the basis of the force generated by the actuator 22 which, in turn, depends on the pressure and the sizing of the actuator 22.

Consequently, in an example of the presented solution, the control unit 30 is, under control of a control algorithm, configured to restrict the speed of the actuator 22 in the above described way, taking into account the amount of hydraulic fluid in the pressure accumulator 26, the pressure of hydraulic fluid in the pressure accumulator 26, as well as the pressure generated by the actuator 22. Said force is defined, for example, by means of a sensor device or said pressure, when the sizing of the actuator are known.

In an example of the presented solution, the control unit 30 is, under control by a control algorithm, configured to restrict the maximum speed of the actuator 22 to a maximum value which is reduced when the amount of hydraulic fluid in the pressure accumulator 26 is reduced; in other words, it is the lower, the lower the amount of hydraulic fluid in the pressure accumulator 26.

In an example of the presented solution, the above described restriction is applied as a method when the amount of hydraulic fluid in the pressure accumulator 26 has dropped to a value equal to or lower than a predetermined limit value.

In an example, said predetermined limit value for the amount of hydraulic fluid in the pressure accumulator 26 is 3%, 5%, 10%, 15%, 20%, or 25% of the useful capacity of the pressure accumulator 26, or of the maximum amount of hydraulic fluid which can be supplied from the pressure accumulator 26.

In an example, and in addition to what has been described above, the control unit 30 is, under control of a control algorithm, configured to reduce the maximum speed of the actuator 22, at its lowest, to a maximum value proportional to the volume flow produced by the pump 12, for example, equal to or lower than the maximum volume flow produced by the pump 12.

The above described proportionality may be based on a function based on the amount of hydraulic fluid in the pressure accumulator 26, or it is linearly declining or following the shape of a declining curve, in view of said amount of hydraulic fluid which is decreasing.

Figure 2:
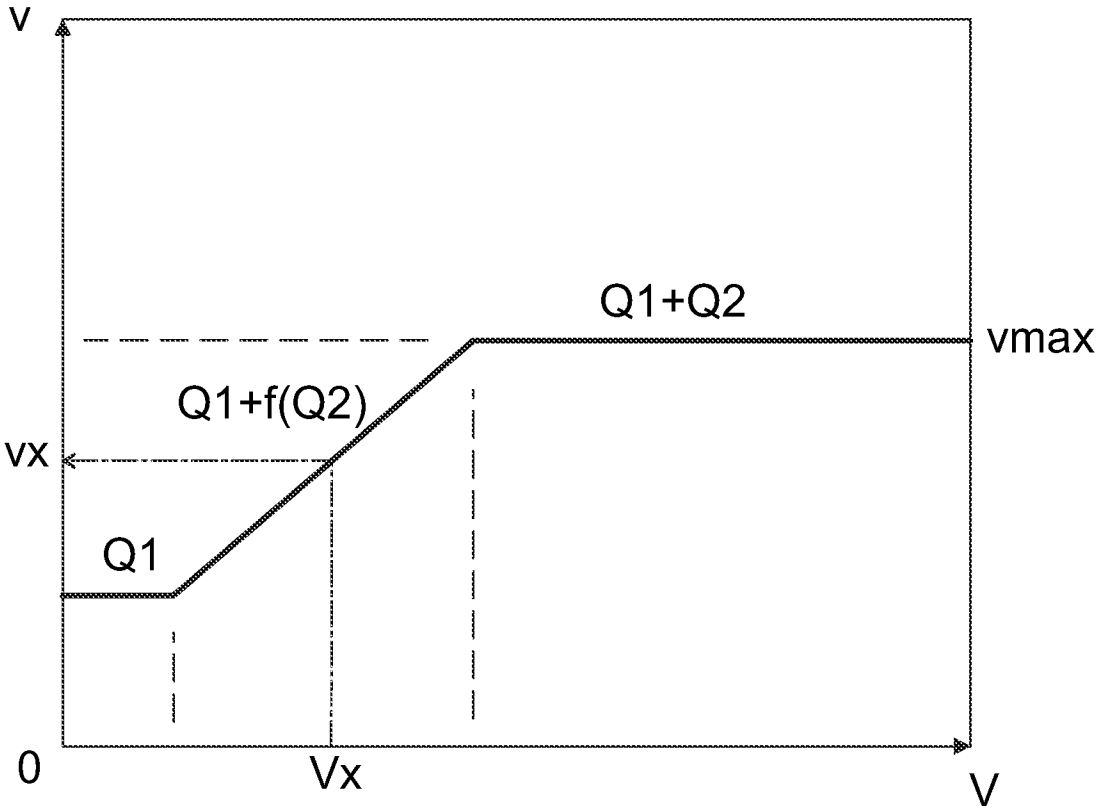
FIG. 2 shows a principle of controlling the speed v of the actuator of the system of FIG. 1, and setting its maximum speed vmax on the basis of the amount V of hydraulic fluid in the pressure accumulator.

FIG. 2 illustrates, with an example, the control of the speed v of the actuator 22 in the system 10, and the determination of the maximum speed vmax set for it, based on the amount V of hydraulic fluid in the pressure accumulator 26.

In the example of FIG. 2, the above described proportionality (see range Q1+f(Q2)) is linear; in other words, it is based on a function. Said proportionality may also be based on a function which is not linear. When the amount V of hydraulic fluid has a value Vx, according to the presented solution it can be deduced that the speed v of the actuator 22 has a maximum value vmax. Thus, in such a range, also such velocities of the actuator 22 are allowable which are lower than the set maximum value.

In the example of FIG. 2, it is also implemented that the above described restriction is applied as a method when the amount of hydraulic fluid in the pressure accumulator 26 has decreased to a level equal to or lower than the predetermined limit value. When the restriction is not in use (see range Q1+Q2), the maximum speed value vmax will be determined, at its maximum, according to the overall volume flow produced by the pump 12 and the pressure accumulator 26 in combination. Thus, in such a range, also such velocities of the actuator 22 are allowable which are lower than the set maximum value.

In the example of FIG. 2, after the amount of hydraulic fluid in the pressure accumulator 26 has decreased sufficiently or been used up, the above described restriction is also implemented so that the maximum speed of the actuator 22 is reduced, at its lowest, to a maximum value proportional to the maximum volume flow produced by the pump 12 (see range Q1). In this range, also such velocities of the actuator 22 are allowable which are lower than the set maximum value. In this case, said velocities are only based on the volume flow produced by the pump 12.

In the example of FIG. 2, the symbol Q1 represents the maximum volume flow produced by the pump 12, and the symbol Q2 represents the volume flow produced by the pressure accumulator 26 and supplied to the actuator 22.

The above described hydraulic system and its control system may be applied in various cranes for lifting and/or moving loads. For this, the crane may be equipped with a boom which may be pivotable in lateral directions by means of a slewing mechanism. The boom may comprise a hoisting boom which may be telescopic. The boom may also comprise a transfer boom which is pivotally connected to the hoisting boom. The transfer boom may be telescopic. The above presented actuator 22 may be an actuator, particularly a linear actuator, for moving the boom, transfer boom or hoisting boom, whereby the above presented load 48 may be the boom, transfer boom or hoisting boom either alone or in combination with a load carried by the boom, transfer boom or hoisting boom. The above presented crane and/or hydraulic system and its control system may be applied in various machines which may be used for hoisting or moving loads and which may be self-propelled machines controlled by a user. Said machine is a forestry machine, such as a forwarder or a felling machine, an excavating machine, or an earth moving machine. Said machine may comprise an implement, such as a bucket, connected to a mechanism for moving the implement. The above described actuator 22 may be an actuator for moving said mechanism.

In the description above, proportionality refers to such proportionality between two different variables, functions or factors which can be represented by means of, for example, a mathematical relation or function. Alternatively or in addition, said proportionality refers to a connection or interdependence between the two different variables, functions or factors, whereby predetermined states of one variable, function or factor correspond to predetermined states of the other variable, function or factor. In this way, one variable, function or factor may be used to control the other variable, function or factor, to make the system according to the presented solution operate in a targeted way.

The presented solution is not limited merely to the alternatives, examples and embodiments which have been presented above and which should not be considered the sole embodiments of the solution. In the presented solution, it is also possible to apply the above presented alternatives, examples and embodiments in combination, for implementing the aims presented above.

The implementation of the solution presented will be defined in more detail in the appended claims.

The invention claimed is:

1. A system which operates hydraulically and comprises:

a pressure line for supplying pressurized hydraulic fluid;

a pump configured to supply pressurized hydraulic fluid to the pressure line;

an actuator connected to the pressure line, for receiving pressurized hydraulic fluid from the pressure line and for moving a load;

a valve device configured to control a flow of pressurized hydraulic fluid from the pressure line to the actuator, and a speed of the actuator;

an electronic control unit configured to monitor and control functions of the system and to control the valve device by a control signal proportional to a targeted speed of the actuator desired at any given time;

a pressure accumulator connected to the pressure line, from which the pressure accumulator may receive pressurized hydraulic fluid and to which the pressure accumulator may, simultaneously with the pump, supply pressurized hydraulic fluid for moving the actuator;

a sensor device configured to measure, directly or indirectly, an amount of pressurized hydraulic fluid in the pressure accumulator at any given time, wherein the sensor device is configured to transmit to the electronic control unit a measurement signal proportional to said amount of pressurized hydraulic fluid; and an input device configured to input a setting signal into the electronic control unit, the setting signal controlling the speed of the actuator, wherein the electronic control unit is adapted to set said control signal to be proportional with the targeted speed of the actuator based on the setting signal at any given time; and the electronic control unit is configured to restrict the targeted speed of the actuator not to exceed a predetermined maximum speed which is proportional to the amount of pressurized hydraulic fluid in the pressure accumulator.

2. The system according to claim 1, wherein the electronic control unit is configured to restrict said targeted speed when the amount of pressurized hydraulic fluid is equal to or lower than a predetermined limit value.

3. The system according to claim 2, wherein the pump is configured to produce a volume flow limited to a predetermined maximum volume flow of the pump; and wherein the electronic control unit is configured to reduce the targeted speed of the actuator to be equal to or lower than a predetermined maximum speed which is proportional to said maximum volume flow of the pump.

4. The system according to claim 1, wherein the pump is configured to produce a volume flow limited to a predetermined maximum volume flow of the pump; and wherein the electronic control unit is configured to reduce the targeted speed of the actuator to be equal to or lower than a predetermined maximum speed which is proportional to said maximum volume flow of the pump.

5. The system according to claim 1, wherein said predetermined maximum speed decreases with the reducing of said amount of pressurized hydraulic fluid.

6. The system according to claim 1, wherein the input device comprises a control device which is a manually controllable control stick.

7. The system according to claim 1, wherein said sensor device is configured to measure a pressure of hydraulic fluid contained in the pressure line at any given time for indirect measurement of said amount of hydraulic fluid in the pressure accumulator, and the electronic control unit is configured to deduce the amount of hydraulic fluid in the pressure accumulator from properties of the pressure accumulator and said pressure of hydraulic fluid contained in the pressure line.

8. The system according to claim 1, wherein said sensor device is connected to the pressure accumulator and configured to measure the amount of hydraulic fluid in the pressure accumulator at any given time.

9. The system according to claim 1, wherein the input device comprises a control device connected to the electronic control unit, configured to generate said setting signal, and configured to set said control signal to be proportional to a position of the control device.

10. The system according to claim 1, wherein the pump is configured to produce a volume flow restricted to a predetermined maximum volume flow of the pump.

11. The system according to claim 1, wherein the electronic control unit is configured to restrict the targeted speed of the actuator to a maximum speed which is proportional to not only the amount of the pressurized hydraulic fluid in the pressure accumulator but also the pressure of the pressurized hydraulic fluid in the pressure accumulator.

12. The system according to claim 11, wherein the electronic control unit is configured to restrict the targeted speed of the actuator to a maximum speed proportional to the amount and pressure of pressurized fluid in the pressure accumulator, and also proportional to a power generated by the actuator at any given time.

13. The system according to claim 1, wherein said actuator is a linear actuator.

14. The system according to claim 13, wherein said linear actuator is a hydraulic cylinder.

15. A method for controlling a system which operates hydraulically and comprises:

a pressure line for supplying pressurized hydraulic fluid;

a pump configured to supply pressurized hydraulic fluid to the pressure line;

an actuator connected to the pressure line, for receiving pressurized hydraulic fluid from the pressure line and for moving a load;

a valve device configured to control a flow of pressurized hydraulic fluid from the pressure line to the actuator, and a speed of the actuator;

an electronic control unit configured to monitor and control functions of the system and to control the valve device by a control signal proportional to a targeted speed of the actuator desired at any given time;

a pressure accumulator connected to the pressure line, from which the pressure accumulator may receive pressurized hydraulic fluid and to which the pressure accumulator may, simultaneously with the pump, supply pressurized hydraulic fluid for moving the actuator;

a sensor device configured to measure, directly or indirectly, an amount of pressurized hydraulic fluid in the pressure accumulator at any given time, wherein the sensor device is configured to transmit to the electronic control unit a measurement signal proportional to said amount of pressurized hydraulic fluid, to the electronic control unit; and an input device configured to input a setting signal into the electronic control unit, the setting signal controlling the speed of the actuator, wherein the electronic control unit is adapted to set said control signal to be proportional with the targeted speed of the actuator based on the setting signal at any given time; and the electronic control unit is configured to restrict the targeted speed of the actuator not to exceed a predetermined maximum speed which is proportional to the amount of pressurized hydraulic fluid in the pressure accumulator, wherein the method comprises:

restricting the targeted speed of the actuator not to exceed a predetermined maximum speed which is proportional to the amount of pressurized fluid in the pressure accumulator.

16. A crane comprising a boom for hoisting and transferring loads, the boom being configured to be movable by a system which operates hydraulically and comprises:

a pressure line for supplying pressurized hydraulic fluid;

a pump configured to supply pressurized hydraulic fluid to the pressure line;

an actuator connected to the pressure line, for receiving pressurized hydraulic fluid from the pressure line and for moving a load;

a valve device configured to control a flow of pressurized hydraulic fluid from the pressure line to the actuator, and a speed of the actuator;

an electronic control unit configured to monitor and control functions of the system and to control the valve device by a control signal proportional to a targeted speed of the actuator desired at any given time;

a pressure accumulator connected to the pressure line, from which the pressure accumulator may receive pressurized hydraulic fluid and to which the pressure accumulator may, simultaneously with the pump, supply pressurized hydraulic fluid for moving the actuator;

a sensor device configured to measure, directly or indirectly, an amount of pressurized hydraulic fluid in the pressure accumulator at any given time, wherein the sensor device is configured to transmit to the electronic control unit a measurement signal proportional to said amount of pressurized hydraulic fluid; and an input device configured to input a setting signal into the electronic control unit, the setting signal controlling the speed of the actuator, wherein the electronic control unit is adapted to set said control signal to be proportional with the targeted speed of the actuator based on the setting signal at any given time; and the electronic control unit is configured to restrict the targeted speed of the actuator not to exceed a predetermined maximum speed which is proportional to the amount of pressurized hydraulic fluid in the pressure accumulator.

17. A mobile machine comprising a crane comprising a boom for hoisting and transferring loads, the boom being configured to be movable by a system which operates hydraulically and comprises:

a pressure line for supplying pressurized hydraulic fluid;

a pump configured to supply pressurized hydraulic fluid to the pressure line;

an actuator connected to the pressure line, for receiving pressurized hydraulic fluid from the pressure line and for moving a load;

a valve device configured to control a flow of pressurized hydraulic fluid from the pressure line to the actuator, and a speed of the actuator;

an electronic control unit configured to monitor and control functions of the system and to control the valve device by a control signal proportional to a targeted speed of the actuator desired at any given time;

a pressure accumulator connected to the pressure line, from which the pressure accumulator may receive pressurized hydraulic fluid and to which the pressure accumulator may, simultaneously with the pump, supply pressurized hydraulic fluid for moving the actuator;

a sensor device configured to measure, directly or indirectly, an amount of pressurized hydraulic fluid in the pressure accumulator at any given time, wherein the sensor device is configured to transmit to the electronic control unit a measurement signal proportional to said amount of pressurized hydraulic fluid;

an input device configured to input a setting signal into the electronic control unit, the setting signal controlling the speed of the actuator, wherein the electronic control unit is adapted to set said control signal to be proportional with the targeted speed of the actuator based on the setting signal at any given time; and the electronic control unit is configured to restrict the targeted speed of the actuator not to exceed a predetermined maximum speed which is proportional to the amount of pressurized hydraulic fluid in the pressure accumulator.

* * * * *